US008362969B2

(12) United States Patent
Olson et al.

(10) Patent No.: US 8,362,969 B2
(45) Date of Patent: Jan. 29, 2013

(54) ADJUSTABLE ANTENNA BAFFLING SYSTEM

(75) Inventors: Steven C. Olson, Broomfield, CO (US); Chad E. Dewey, Arvada, CO (US)

(73) Assignee: ARC Wireless Solutions, Inc., Denver, CO (US)

( * ) Notice: Subject to any disclaimer, the term of this patent is extended or adjusted under 35 U.S.C. 154(b) by 330 days.

(21) Appl. No.: 12/870,897

(22) Filed: Aug. 30, 2010

(65) Prior Publication Data

US 2012/0050128 A1 Mar. 1, 2012

(51) Int. Cl.
*H01Q 3/02* (2006.01)
*H01Q 19/10* (2006.01)

(52) U.S. Cl. ..... 343/893; 343/757; 343/882

(58) Field of Classification Search ..... 343/757, 343/878, 882, 880, 893, 907
See application file for complete search history.

(56) References Cited

U.S. PATENT DOCUMENTS

| | | | | |
|---|---|---|---|---|
| 2006/0197713 | A1* | 9/2006 | Mansour et al. | 343/882 |
| 2006/0251115 | A1* | 11/2006 | Haque et al. | 370/466 |
| 2008/0284669 | A1* | 11/2008 | Hunton et al. | 343/757 |
| 2011/0193764 | A1* | 8/2011 | Shen | 343/882 |
| 2012/0132781 | A1* | 5/2012 | Kolokotronis | 248/535 |

* cited by examiner

*Primary Examiner* — Don Le
(74) *Attorney, Agent, or Firm* — Ancel W. Lewis, Jr.

(57) ABSTRACT

An adjustable antenna baffling system includes a mounting plate for antenna radiating elements, baffles, connecting links that connect the baffles to the mounting plate, limit brackets that limit movement of the connecting links, an actuator and a housing. Pushing or pulling a handle on the actuator rotates the connecting links and extends or retracts the baffles to adjust the beamwidth. The housing encloses the components of the system except the handle and a lock tab on the mounting plate. The handle is secured to the lock tab to lock the baffles in the selected position.

14 Claims, 4 Drawing Sheets

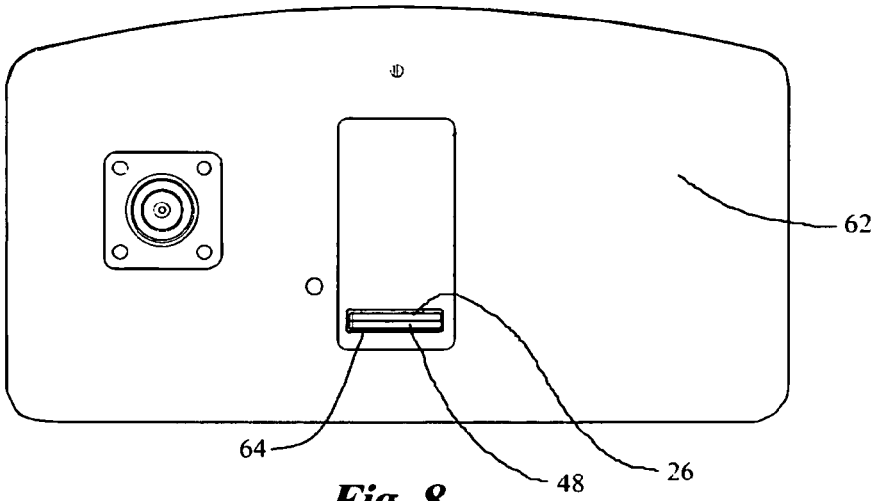
*Fig. 8*
*Fig. 9*
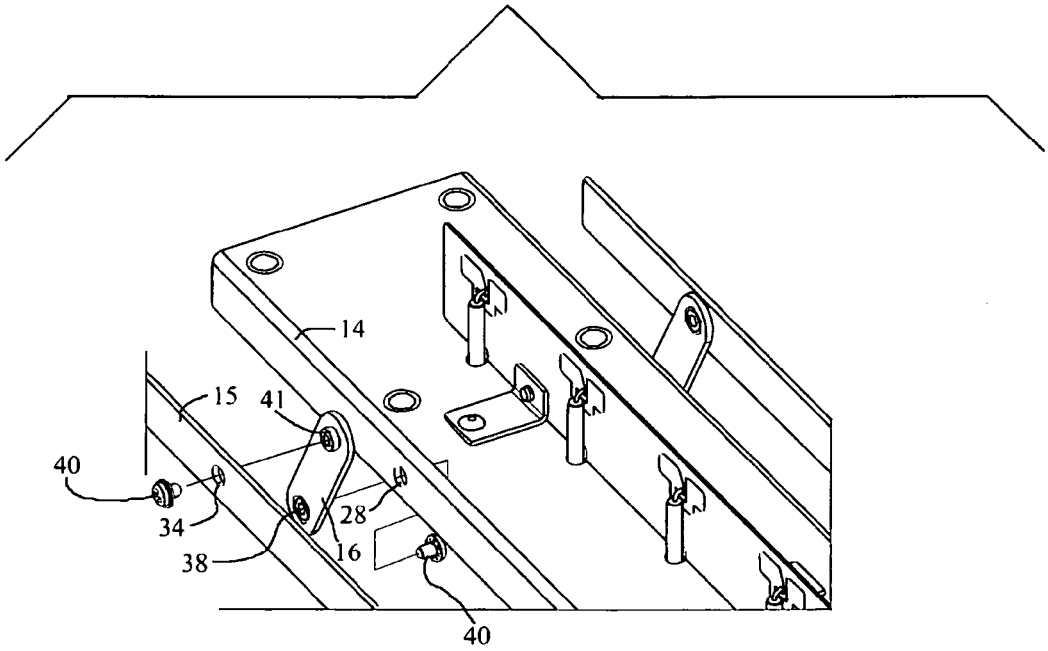

ADJUSTABLE ANTENNA BAFFLING SYSTEM

TECHNICAL FIELD

The present invention relates to antennas and more particularly to an system with adjustable baffles for adjusting the azimuth beamwidth of an antenna.

BACKGROUND ART

Wireless networks are designed to optimally provide system coverage of the geographic surrounding area. Different basestation antennas often have different azimuth beamwidths. The azimuth beamwidth represents the sector coverage of that particular basestation antenna. The network system designer chooses an antenna with a specific azimuth beamwidth based on predicted system usage in a given geographic area. Multiple fixed azimuth beamwidth antennas may be sourced for a network.

In an effort to reduce the number of antenna types required for a wireless network and ease the process of adapting a wireless network to changing demand levels, adjustable antennas can be used. With an adjustable azimuth beamwidth antenna a single antenna model can be purchased and each antenna that is installed in the network can be adjusted to the required azimuth beamwidth to optimize the network performance. Furthermore, due to changes in system demands over time the azimuth beamwidth can be adjusted in the field without removal or replacement of the antenna.

The antenna beamwidth can be controlled with metal plates, called baffles, that have a selected height and that are spaced a selected distance from the antenna radiating elements. Prior known adjustable azimuth beamwidth antennas have used large baffles attached to the antenna, increasing the antenna size and weight. Typically these baffles are external to the antenna. This type of antenna does not allow for easy field adjustability as multiple baffles, one on each side of the antenna, must be attached to the antenna. When external baffles are attached to an antenna, mechanical and environmental conditions such as wind, ice and snow load become an added concern.

DISCLOSURE OF THE INVENTION

An adjustable antenna baffling system includes a mounting plate, a pair of baffles, a plurality of spaced connecting links, a pair of limit brackets, an actuator and a housing. The mounting plate has a flat mounting portion for mounting radiating elements and a pair of spaced lateral portions. Each baffle is an elongated, flat bar. One end of each connecting link rotatably connects to a lateral portion and the other end of each connecting link rotatably connects to a baffle such that all of the connecting links connected to a baffle are parallel. A limit bracket attaches to one end of each baffle and limits movement of the baffle towards the mounting plate. The actuator has a actuator plate and a pair of actuator links. The actuator plate slidably mounts at one end of the mounting plate and has a pair of lateral tabs. One end of each actuator link rotatably connects to a lateral tab and the other end of each actuator link rotatably connects to a limit bracket such that sliding the actuator plate forces the connecting links to rotate, moving the baffles towards or away from the mounting plate. The housing has a pair of end caps that mount on opposite ends of the mounting plate, and a body that extends between the end caps and encloses the mounting plate and baffles. The actuator plate has a handle that projects through one end cap and the mounting plate has a lock tab that projects through the same end cap. The handle allows external adjustment of the baffles and can be secure in a selected position with the lock tab.

BRIEF DESCRIPTION OF THE DRAWINGS

Details of this invention are described in connection with the accompanying drawings that bear similar reference numerals in which:

FIG. 8 is a bottom plan view of the system of FIG. 1.

FIG. 9 is a partial, enlarged, exploded perspective view of the mounting plate, baffles and connecting links of the system of FIG. 1.

DETAILED DESCRIPTION OF THE INVENTION

Figure 1:
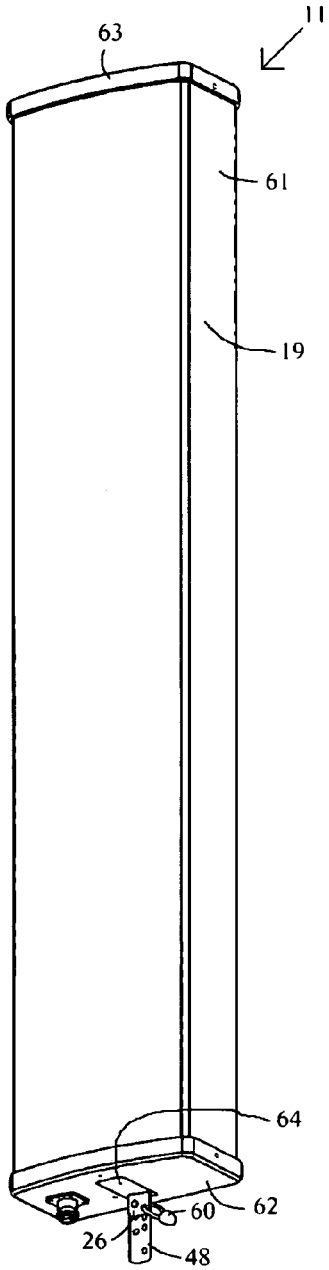
FIG. 1 is a front perspective view of an adjustable antenna baffling system embodying features of the present invention.
Figure 2:
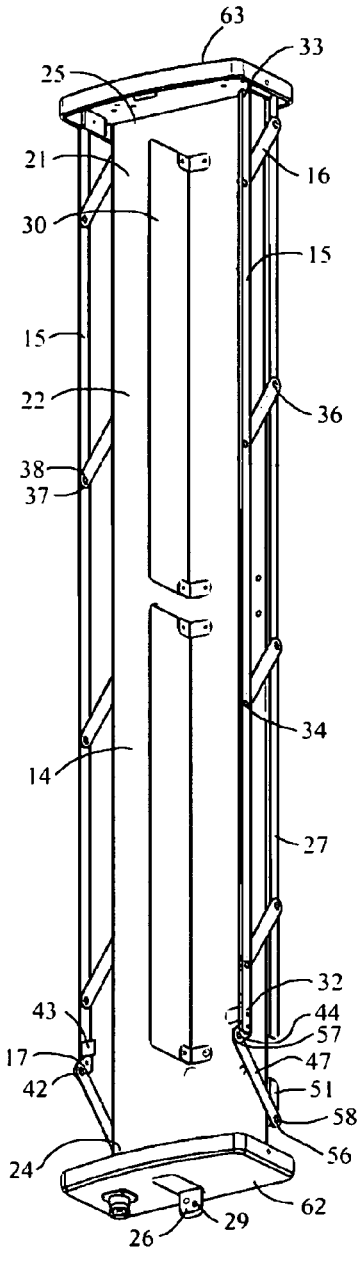
FIG. 2 is a front perspective view of the system of FIG. 1 with the housing body removed and the baffles extended.
Figure 3:
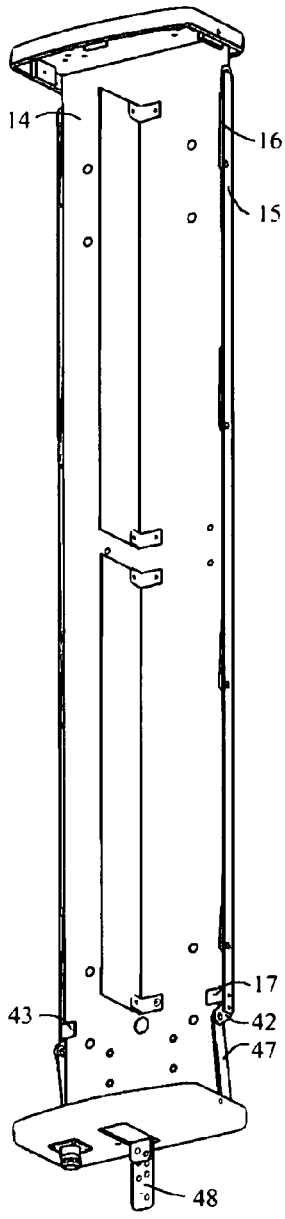
FIG. 3 is a front perspective view of the system of FIG. 1 with the housing body removed and the baffles retracted.
Figure 4:
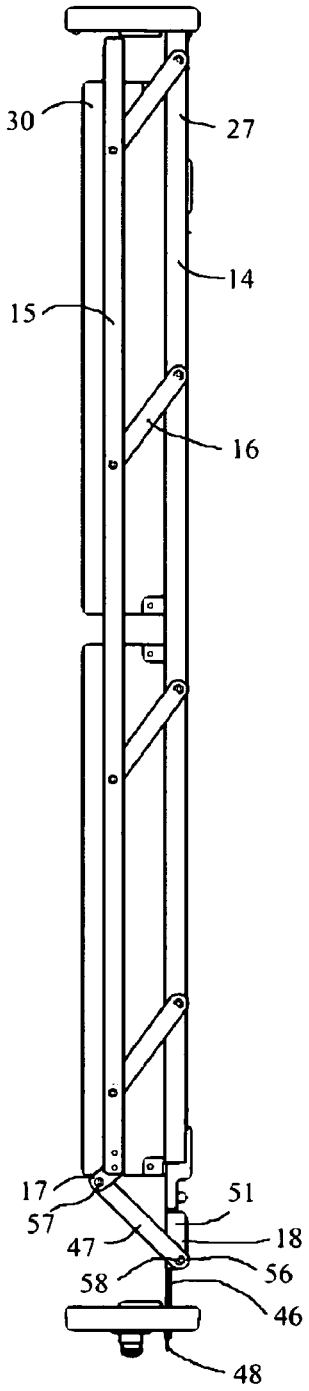
FIG. 4 is a side elevational view of the system of FIG. 1 with the housing body removed and the baffles extended.
Figure 5:
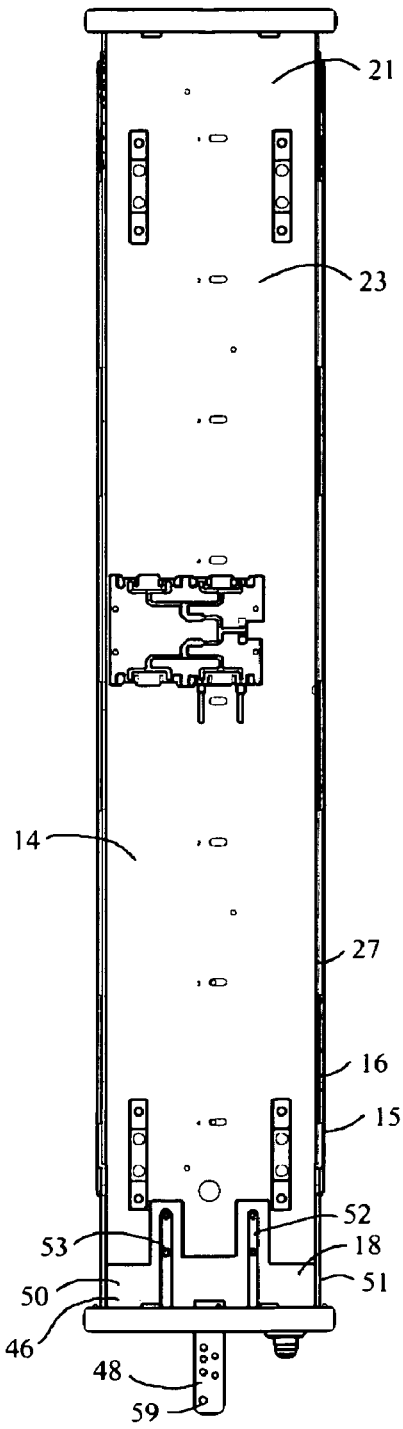
FIG. 5 is a rear elevational view of the system of FIG. 1 with the housing body removed.
Figure 6:
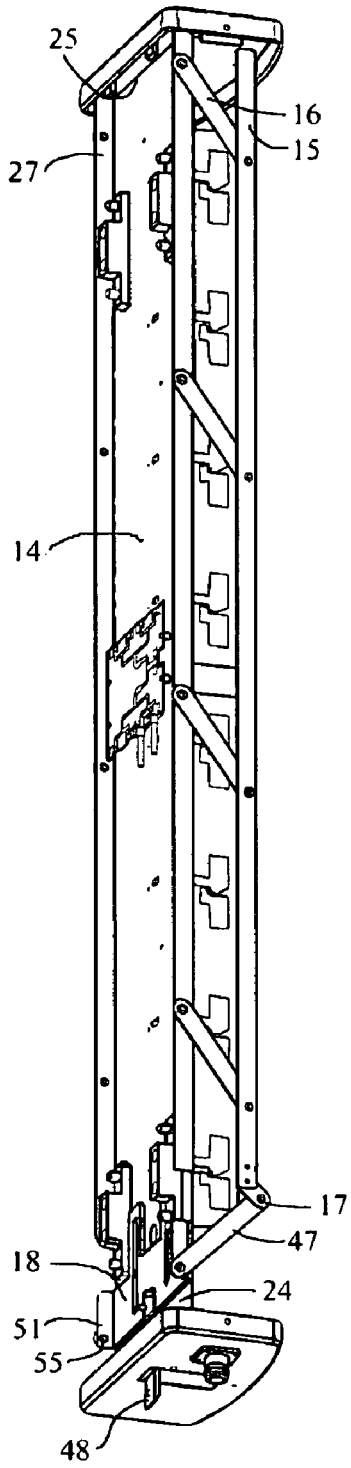
FIG. 6 is a rear perspective view of the system of FIG. 1 with the housing body removed and the baffles extended.
Figure 7:
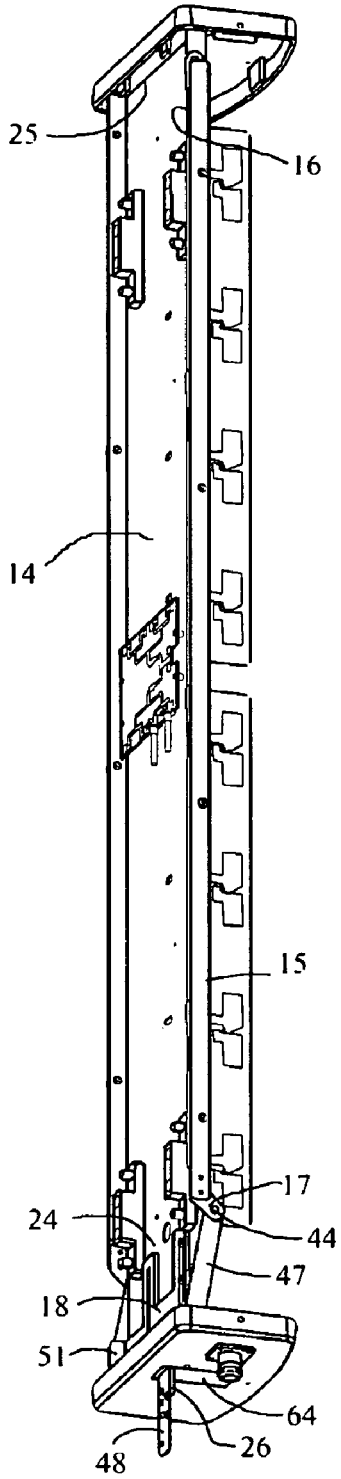
FIG. 7 is a rear perspective view of the system of FIG. 1 with the housing body removed and the baffles retracted.

Referring now to FIGS. 1 to 9, an adjustable antenna baffling system 11 includes a mounting plate 14, a pair of baffles 15, a plurality of connecting links 16, a pair of limit brackets 17, an actuator 18 and a housing 19. The mounting plate 14 has a flat, elongated, rectangular mounting portion 21 with a first face 22, an oppositely facing second face 23, a first end 24 and a spaced second end 25. A lock tab 26 projects from the middle of the first end 24 of the mounting portion 21.

A pair of spaced lateral portions 27 project transversely to the mounting portion 21 from opposite sides of the mounting portion 21 away from the first face 22. The lateral portions 27 extend from the second end 25, and stop or terminate a selected distance from the first end 24. A plurality of spaced plate apertures 28 extend through each lateral portion 27. A plurality of spaced lock apertures 29 extend through the lock tab 26. Radiating elements 30 for an antenna are mounted on the first face 22.

Each baffle 15 is a flat, elongated bar having a first end 32 and a spaced second end 33. A plurality of spaced baffle apertures 34 extend through each baffle 15. The spacing of the baffle apertures 34 is the same as the spacing of the plate apertures 28 in the lateral portions 27 of the mounting plate 14. There is a connecting link 16 for each plate aperture 28. The connecting links 16 are a flat, elongated bars of equal length with each having a first end 36 and a spaced second end 37. A link aperture 38 extends through the first end 36 of each connecting link 16 and a link aperture 38 extends through the second end 37 of each connecting link 16.

Each connecting link 16 rotatably mounts to the mounting plate 14 with a fastener 40 through one of the plate apertures 28 in one of the lateral portions 27 of the mounting plate 14 and through the link aperture 38 in the first end 36 of the connecting link 16. The fastener 40 can be a screw, rivet or other hardware, and may include a standoff 41. The connecting links 16 connected to one of the lateral portions 27 of the mounting plate 14 connect to one of the baffles 15, and the connecting links 16 connected to the other lateral portion 27 of the mounting plate 14 connect to the other baffle 15. The connecting links 16 rotatably mount to the baffles 15 with a fastener 40 through one of the baffle apertures 34 and through the link aperture 38 in the second end 37 of the connecting link 16.

The baffles 15 are mounted with the first end 32 of each baffle 15 toward the first end 24 of the mounting portion 21 of the mounting plate 14. The connecting links 16 keep each baffle 15 parallel to the mounting portion 21, and rotation of the connecting links 16 extends the baffle 15 away from the mounting portion 21 or retracts the baffle 15 toward the mounting portion 21.

A limit bracket 17 rigidly attaches to the first end 32 of each baffle 15. Each limit bracket 17 has a link portion 42 that projects diagonally away from the first end 32 of the baffle 15 and away from the first face 22 of the mounting portion 21, and a limit tab 43 that projects over the first face 22 of the mounting portion 21 toward the other baffle 15. A bracket aperture 44 extends through the link portion 42. The limit tab 43 contacts the first face 22 to limit retraction of the baffle 15 and to prevent movement of the baffle 15 to the second face 23 side of the mounting portion 21.

The actuator 18 includes an actuator plate 46, a pair of actuator links 47 and a handle 48. The actuator plate 46 has a flat plate portion 50 and a pair of spaced lateral tabs 51 that project transversely from opposite sides of the plate portion 50. The distance between the lateral tabs 51 is about the same as the distance between the lateral portions 27 of the mounting plate 14. The plate portion 50 has a pair of spaced, elongated slots 52 that are parallel to and spaced between the lateral tabs 51. The actuator plate 46 is slidably mounted to the second face 23 at the first end 24 of the mounting portion 21 of the mounting plate 14 by two guide pins 53 sliding in each slot 52 and rigidly mounting to the mounting portion 21. The guide pins 53 can be a fastener 40 and standoff 41 arrangement such as that used to connect the connecting links 16. The actuator plate 46 slides towards or away from the first end 24 of the mounting portion 21 of the mounting plate 14. A plurality of lock apertures 29 extend through the lock tab 26.

Each lateral tab 51 includes a tab aperture 55. The actuator links 47 are flat, elongated bars of equal length with each having a first end 56 and a spaced second end 57. A link aperture 58 extends through the first end 56 of each actuator link 47 and a link aperture 58 extends through the second end 57 of each connecting link 47.

Each actuator link 47 rotatably mounts to the actuator plate 46 with a fastener 40 through the tab aperture 55 in one of the lateral tabs 51 and through the link aperture 58 in the first end 56 of the actuator link 47. Each actuator link 47 rotatably mounts to one of the limit brackets 17 with a fastener 40 through the bracket aperture 44 and through the link aperture 58 in the second end 57 of the actuator link 47. The handle 48 rigidly attaches to the plate portion 50 of the actuator plate 46 and projects beyond the first end 24 of the mounting portion 21 of the mounting plate 14. A plurality of lock apertures 59 extend through the handle 48.

The connecting links 16 shown angle away from the first face 22 of the mounting portion 21 of the mounting plate 14 toward the first end 24. The actuator links 47 shown angle away from the first face 22 of the mounting portion 21 of the mounting plate 14 toward the second end 25. Pushing the handle 48 slides the actuator plate 46 towards the second end 25 of the mounting portion 21 of the mounting plate 14, extending the baffles 15 away from the first face 22 of the mounting portion 21 of the mounting plate 14. Pulling the handle 48 slides the actuator plate 46 towards the first end 24 of the mounting portion 21 of the mounting plate 14, retracting the baffles 15 towards the first face 22 of the mounting portion 21 of the mounting plate 14. A means for locking 60 the actuator plate 46 in a selected position, such a lock, tag or seal, through one of the lock apertures 29 in the lock tab 26 and through one of the lock apertures 59 in the handle 48 secures the baffles 15 in the selected position.

The housing 19 includes a body 61, a first end cap 62 and a second end cap 63. The first end cap 62 attaches to the first end 24 of the mounting portion 21 of the mounting plate 14. The second end cap 63 attaches to the second end 25 of the mounting portion 21 of the mounting plate 14. The body 61 extends from the first end cap 62 to the second end cap 63, and encloses the mounting plate 14, baffles 15, connecting links 16, limit brackets 17 and actuator 18, except the lock tab 26 and the handle 48. The lock tab 26 and the handle 48 project through a cap aperture 64 in the first end cap 62 to the exterior of the housing 19.

Although the present invention has been described with a certain degree of particularity, it is understood that the present disclosure has been made by way of example and that changes in details of structure may be made without departing from the spirit thereof.

What is claimed is:

1. An adjustable antenna baffling system for adjusting the beamwidth of an antenna, comprising:

a mounting plate having a mounting portion with a first end, a spaced second end, a first face for mounting at least one radiating element for said antenna, and an oppositely facing second face, a pair of spaced, parallel baffles, and a plurality of spaced, parallel connecting links each having a first end and a spaced second end, said first ends rotatably mounting along opposite sides of said mounting portion and said second ends each rotatably mounting to one of said baffles, whereby rotation of said connecting links moves said baffles towards and away from said first face and thereby adjusts the beamwidth of said antenna.

2. The system as set forth in claim 1 including an actuator connected to said mounting plate that causes said connecting links to rotate and move said baffles towards and away from said mounting plate.

3. The system as set forth in claim 2 wherein said actuator includes an actuator plate slidably mounted to said mounting plate and a pair of actuator links each having a first end and a spaced second end, said first ends rotatably mounting to said actuator plate and said second end of each said actuator link rotatably mounting to one of said baffles, whereby sliding said actuator plate moves said baffles, causing said connecting links to rotate and said baffles to move towards or away from said mounting plate.

4. The system as set forth in claim 3 wherein said actuator plate mounts on said second face at said first end of said mounting portion.

5. The system as set forth in claim 4 wherein said actuator plate includes a handle that projects beyond said second end of said mounting portion, for manual movement of said actuator.

6. The system as set forth in claim 5 including means for locking said actuator plate in a selected position, said means for locking securing said baffles in a selected position.

7. The system as set forth in claim 6 wherein:

said mounting plate includes a lock tab that projects from said first end of said mounting portion adjacent to said handle, said lock tab having a plurality of spaced lock apertures, said handle has a plurality of spaced lock apertures, and said means for locking extends through one of said lock apertures in said lock tab and one of said lock apertures in said handle to secure said baffles in a selected position.

8. The system as set forth in claim 7 wherein said means for locking includes one of a lock, a tag and a seal.

9. The system as set forth in claim 1 wherein each said baffle is a flat, elongated bar.

10. The system as set forth in claim 1 including a limit bracket connected to each said baffle, said limit brackets limiting retraction of said baffles.

11. The system as set forth in claim 1 wherein said mounting plate includes a pair of spaced lateral portions that project transversely to said mounting portion from opposite sides of said mounting portion away from said first face, and said first ends of said connecting links rotatably mount to said lateral portions.

12. The system as set forth in claim 1 including a housing connected to said mounting plate, said housing enclosing said first face of said mounting portion, said baffles and said connecting links.

13. The system as set forth in claim 12 including an actuator mounted on said mounting plate and connected to said baffles, said actuator extending outside of said housing, whereby said baffles are adjusted from outside said housing.

14. An adjustable antenna baffling system for adjusting the beamwidth of an antenna, comprising:

a mounting plate having a mounting portion with a first end, a spaced second end, a first face for mounting at least one radiating element for said antenna, and an oppositely facing second face, said mounting plate including a pair of spaced lateral portions that project transversely to said mounting portion from opposite sides of said mounting portion away from said first face, and a lock tab that projects from said first end of said mounting portion, said lock tab having a plurality of spaced lock apertures, a pair of spaced, parallel, elongated, bar shaped baffles, each said baffle having a limit bracket that limits retraction of said baffle, a plurality of spaced, parallel connecting links each having a first end and a spaced second end, said first ends rotatably mounting to said lateral portions and said second ends each rotatably mounting to one of said baffles, an actuator having an actuator plate slidably mounted to said second face of said mounting portion at said first end, and a pair of actuator links each having a first end and a spaced second end, said first ends rotatably mounting to said actuator plate and said second end of each said actuator link rotatably mounting to one of said baffles, said actuator plate having a handle projecting adjacent to said lock tab, said handle having a plurality of spaced lock apertures, means for locking said actuator plate in a selected position, said means for locking extending through one of said lock apertures in said lock tab and one of said lock apertures in said handle, and a housing connected to said mounting plate, said housing enclosing said first face of said mounting portion, said baffles, said connecting links, and said actuator links, whereby rotation of said connecting links moves said baffles towards and away from said first face and thereby adjusts the beamwidth of said antenna, and said baffles are adjusted from outside said housing.

* * * * *